US008782818B2

(12) United States Patent
Ho

(10) Patent No.: US 8,782,818 B2
(45) Date of Patent: Jul. 22, 2014

(54) SAFETY HELMET STRUCTURE AND PROCESSING METHOD THEREOF

(76) Inventor: Chang-Hsien Ho, Taoyuan County (TW)

( * ) Notice: Subject to any disclaimer, the term of this patent is extended or adjusted under 35 U.S.C. 154(b) by 509 days.

(21) Appl. No.: 12/453,519

(22) Filed: May 14, 2009

(65) Prior Publication Data

US 2010/0287687 A1 Nov. 18, 2010

(51) Int. Cl.
*A42B 3/00* (2006.01)

(52) U.S. Cl.
USPC ..... 2/411; 2/425

(58) Field of Classification Search
USPC ..... 2/411, 410, 412, 417, 422, 425, 6.6
See application file for complete search history.

(56) References Cited

U.S. PATENT DOCUMENTS

| | | | | | |
|---|---|---|---|---|---|
| 2,808,099 | A * | 10/1957 | Silverman | 156/479 |
| 4,248,657 | A * | 2/1981 | Henry | 156/443 |
| 5,833,796 | A * | 11/1998 | Matich | 156/285 |
| 6,105,176 | A * | 8/2000 | Egger | 2/425 |
| 6,532,602 | B2 * | 3/2003 | Watters et al. | 2/411 |
| 7,311,956 | B2 * | 12/2007 | Pitzen | 428/40.1 |
| 7,789,986 | B2 * | 9/2010 | Brown et al. | 156/216 |
| 2003/0183327 | A1 * | 10/2003 | Titze | 156/212 |
| 2005/0098257 | A1 * | 5/2005 | Bauer et al. | 156/212 |
| 2005/0170128 | A1 * | 8/2005 | Lai | 428/42.3 |
| 2005/0263241 | A1 * | 12/2005 | Lidicky et al. | 156/216 |
| 2006/0185991 | A1 * | 8/2006 | Abercia et al. | 206/232 |
| 2007/0119538 | A1 * | 5/2007 | Price et al. | 156/242 |
| 2007/0130673 | A1 * | 6/2007 | Wasserkrug et al. | 2/411 |
| 2007/0157370 | A1 * | 7/2007 | Joubert Des Ouches | 2/410 |

* cited by examiner

*Primary Examiner* — Khoa Huynh
*Assistant Examiner* — Andrew W Collins
(74) *Attorney, Agent, or Firm* — Rosenberg, Klein & Lee

(57) ABSTRACT

A safety helmet structure and a processing method thereof. The safety helmet includes a first section, a second section and an extension section defined between the first and second sections. The first section is sprayed with a figure. A decorative section or a figure layers is adhered to the second section. After a periphery of the decorative section or figure layer partially passes over an edge of the second section, the periphery of the decorative section or figure layer enters the extension section. The first and second sections together form a helmet subassembly. The helmet subassembly is placed in a mold and integrally bonded with a buffer material or foam material filler to form a helmet assembly.

31 Claims, 5 Drawing Sheets

SAFETY HELMET STRUCTURE AND PROCESSING METHOD THEREOF

BACKGROUND OF THE INVENTION

The present invention is related to a safety helmet structure and a processing method thereof. The safety helmet structure has several sections, which are defined in accordance with the layout of decorative sections or figure layers. The decorative sections or figure layers are attached to set sections, which are covered or wrapped with the decorative sections or figure layers. The sections are connected to form a helmet subassembly. The helmet subassembly is integrally bonded with a buffer material to form a helmet assembly.

A conventional safety helmet has a plastic shell. The surface of the plastic shell is printed or sprayed with a figure. Alternatively, a decorative section or a figure layer is attached to the surface of the plastic shell. The plastic shell is retained in a sealed vacuum mold with a helmet-shaped module. A foam material filler is heated, whereby the plastic shell encloses the foam material filler. Accordingly, the plastic shell is integrally bonded with the foam material filler to form a safety helmet structure for a bicycle rider or a horse rider.

In order to enhance quality feeling or attraction of the safety helmet, the surface of the helmet is often sprayed with colorful figures. Alternatively, figure layers or fabric materials are attached to and overlaid on the surface of the helmet. In practice, after the plastic shell is molded, some set regions of the surface of the plastic shell are sprayed with the figures or the figure layers or fabric materials are adhered to set regions. (The spraying operation or the figure layer adhesion operation can be performed before or after the plastic shell is bonded with the foam material filler.) The above manufacturing process of the safety helmet has some defects as follows:

1. Only those skilled operators are relied on to perform the figure layer adhesion operation. The figured attachable papers or fabrics are laid out on the set regions with certain borders and profiles. In the case that the operator is not skilled enough to smoothly adhere the figure layers or fabric materials to the plastic shell, the peripheries of the figure layers or fabric materials are often crimped as shown by area A of FIG. 1. This is because when adhering the figured attachable paper or fabric to the surface of the plastic shell, the operator will push and stretch the figure layer so as to smoothly adhere the same onto the surface of the plastic shell. In this case, the periphery of the figure layer often partially exceeds or passes over the set region of the plastic shell. Especially, with respect to an elastic attachable paper or an elastic attachable fabric, the periphery thereof will more apparently exceed or pass over the set region of the plastic shell. In general, the operator needs to expense extra time to fix the figure layer so as not to ruin any other portion of the surface of the helmet, on which a figure is sprayed or a figure layer is adhered. This makes it more difficult to manufacture or process the helmet and increases manufacturing time.
2. In prior art, a precise dimension of the figure layer is specifically required so as to conform the figure layer to the set region without exceeding the planned position. However, it is hard to control the sizes of those elastic figure layers or fabric materials. Therefore, in the adhesion operation, it still often takes place that the periphery of the figure layer exceeds or passes over the set region to a certain extent.
3. In the case that the periphery of the figure layer exceeds or passes over the set region without possibility of fully fixing or smoothening the periphery of the figure layer, an operator will have to partially crimp the periphery of the figure layer so as to adhere the figure layer within the set region.
4. In the case that the selected figured attachable paper or attachable fabric has a considerable thickness, in practice, when molding the plastic shell, the plastic shell is often formed with slightly recessed region for adhering the figure layer therein in flush with the surface of the helmet. Under such circumstance, it is especially required that the figure layer is adhered to the set region without exceeding or passing over the set region. This is because the periphery of the figure layer exceeds or passes over the set region, the surface of the helmet will become unsmooth to ruin the entire appearance of the helmet.
5. In the case that the adhesion operation is preformed by an unskilled operator, the periphery of the figure layer is more likely to be partially squeezed or crimped. Also, in the figure layer adhesion operation, an unskilled operator often incautiously applies successive adhesive to other regions of the plastic shell to contaminate the same.
6. A large number of workers are needed to perform the figure layer adhesion operation without possibility of mass-processing the helmets by means of machines. It is difficult to have all the workers skilled in the adhesion operation so that it is hard to control the quality of the products.

It is therefore tried by the applicant to provide a safety helmet structure and a processing method thereof to solve the above problems existing in the prior art. In the safety helmet structure of the present invention, the decorative sections or figure layers are adhered to set regions of the surface of the helmet in flush with the surface thereof. Moreover, the decorative sections or figure layers can be easily smoothly adhered to the set regions by those not very skilled in the adhesion operation. Also, the processing time is shortened and the ratio of defective products is lowered.

SUMMARY OF THE INVENTION

It is therefore a primary object of the present invention to provide a safety helmet structure and a processing method thereof. The safety helmet includes a first section, a second section and an extension section defined between the first and second sections. The first section is sprayed with a figure. A decorative section or a figure layers is adhered to the second section. After a periphery of the decorative section or figure layer partially passes over an edge of the second section, the periphery of the decorative section or figure layer enters the extension section. The first and second sections together form a helmet subassembly. The helmet subassembly is placed in a mold and integrally bonded with a buffer material or foam material filler to form a helmet assembly. Accordingly, the problems existing in the prior art that the periphery of the figure layer tends to crimp, the processing time is long and a large number of skilled workers are demanded can be improved.

According to the above object, the decorative section or figure layer of the safety helmet is allowed to have a dimension or an area slightly larger than that of the second section. After the periphery of the decorative section or figure layer at least totally or partially passes over an edge of the second section, the periphery of the decorative section or figure layer enters the extension section or is folded back and adhered to the inner surface of the second section to wrap the edge thereof. Under such circumstance, it is unnecessary for the decorative section or figure layer to have a dimension, which is strictly demanded to completely conform to the planned region of the helmet as in the prior art. Also, even an unskilled operator can smoothly adhere the elastic figure layer to the set region of the surface of the helmet.

The processing method for the safety helmet structure of the present invention includes steps of:

(a) respectively forming a first section and a second section in accordance with the regions of the surface of the safety helmet where the decorative sections or figure layers are planned to be laid out, each of the first and second sections having an outer surface and an inner surface, an extension section being defined between the first section and the second section, an edge of the second section being formed with a juncture section;

(b) attaching the decorative section or figure layer to the outer surface of the second section, after the periphery of the decorative section or figure layer totally or partially passes over the edge of the second section, the periphery of the decorative section or figure layer entering the extension section or being folded back and adhered to the inner surface of the second section to wrap the edge thereof;

(c) connecting the juncture section of the second section with the first section, whereby the first section and the second section are connected to form a helmet subassembly; and (d) placing the helmet subassembly into a mold in which a buffer material or foam material filler is filled, whereby the helmet subassembly is integrally bonded with the buffer material or foam material filler to together form a helmet assembly.

In contrast, in the prior art, the figure layer adhesion operation can be locally performed only after the entire painted shell has dried. This leads to waste of time, especially in the case of a large amount of work pieces.

This is improved in the present invention.

The present invention can be best understood through the following description and accompanying drawings wherein:

DETAILED DESCRIPTION OF THE PREFERRED EMBODIMENTS

Figure 1:
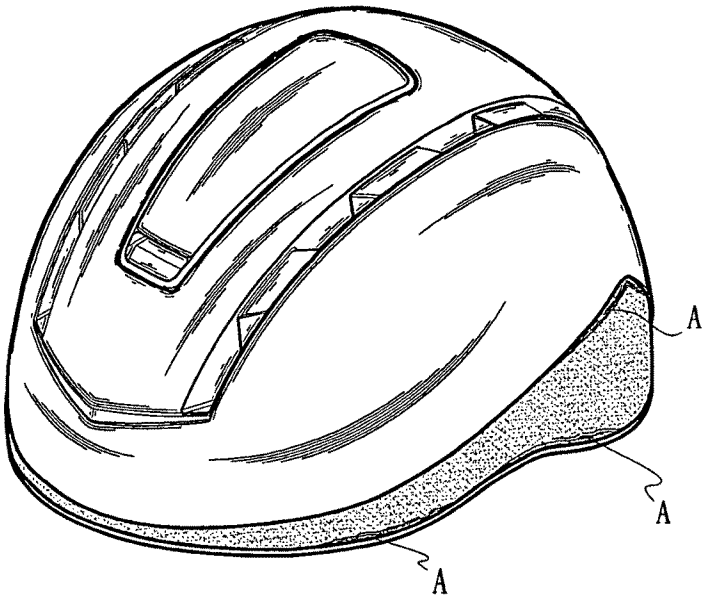
Fig. 1 PRIOR ART
FIG. 1 is a perspective view of a conventional safety helmet on which a decorative section or a figure layer is adhered.
Figure 2:
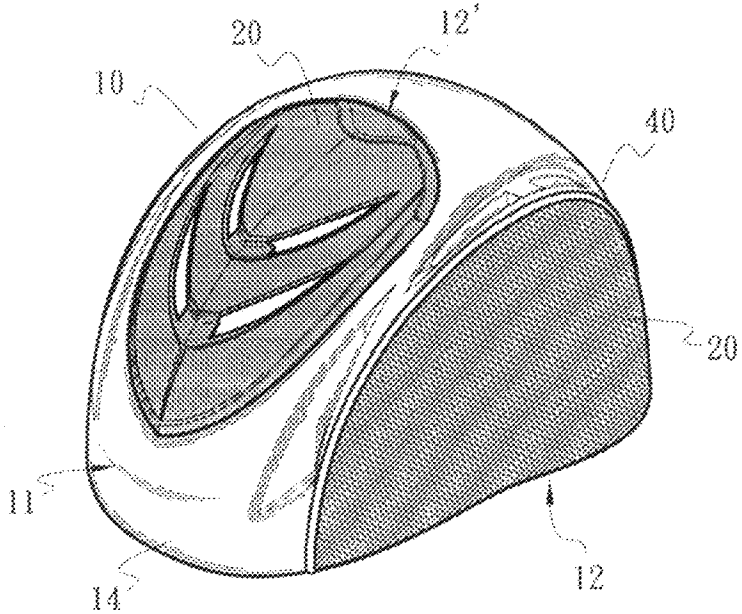
FIG. 2 is a perspective assembled view of the safety helmet of the present invention.
Figure 3:
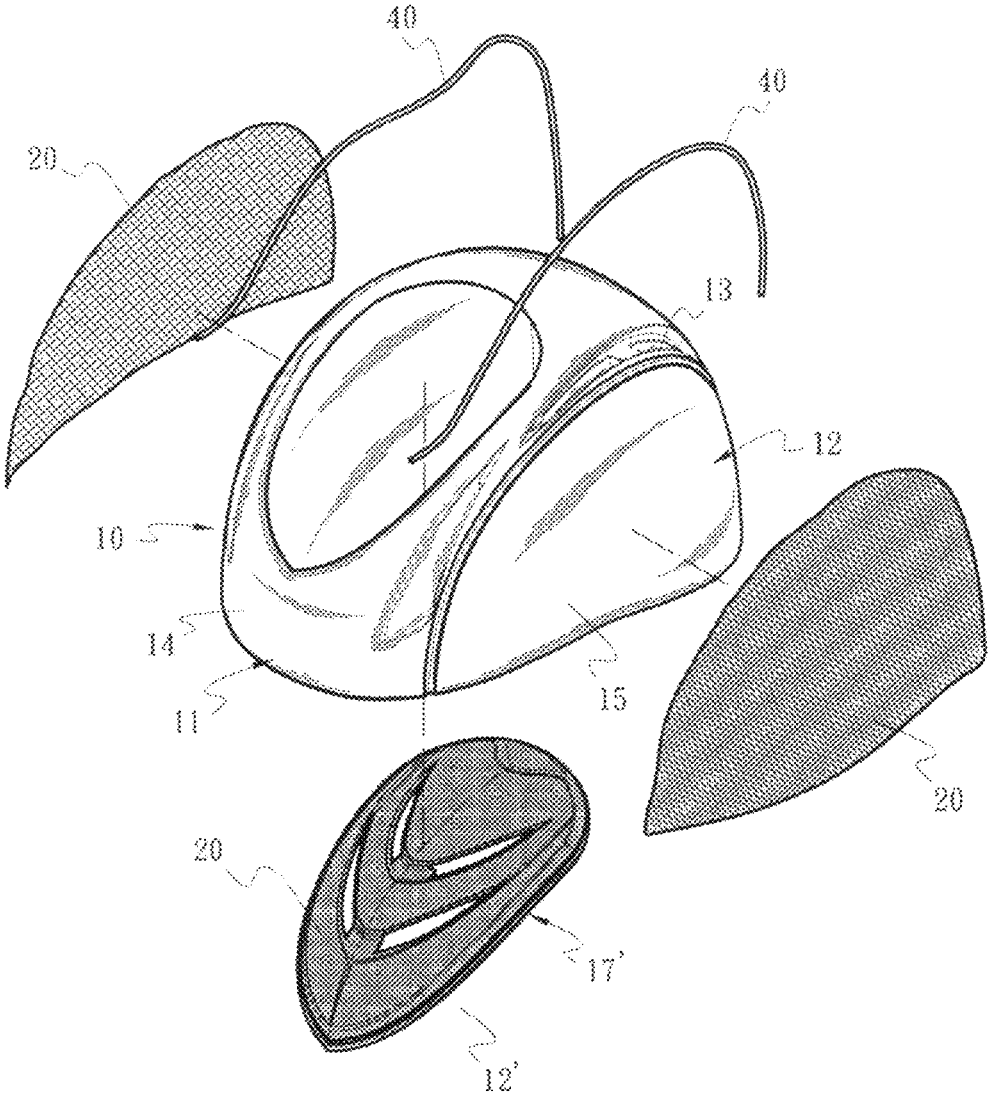
FIG. 3 is a perspective exploded view of the safety helmet of the present invention.

Please refer to FIGS. 2 and 3. According to a preferred embodiment, the safety helmet structure of the present invention is a horse-riding safety helmet 10. The safety helmet 10 includes at least one first section 11 and at least one second section 12, 12'. In this embodiment, the first and second sections 11, 12, 12' are defined in accordance with the regions of or positions on the surface of the safety helmet where the decorative sections or figure layers 20 are planned to be laid out. FIG. 3 shows that the second sections 12, 12' include three regions, that is, two lateral sides of the safety helmet 10 and an upper side of the safety helmet 10. Preferably, the first section 11 is detachably connected with the second section 12'. An edge of the second section 12' is formed with a stepped juncture section 17'. An extension section 13 is defined between the first section 11 and the second section 12. In this embodiment, the extension section 13 is a groove with a geometrical configuration. The first and second sections 11, 12, 12' together form a subassembly of the safety helmet. (This will be further described hereinafter.)

Figure 5:
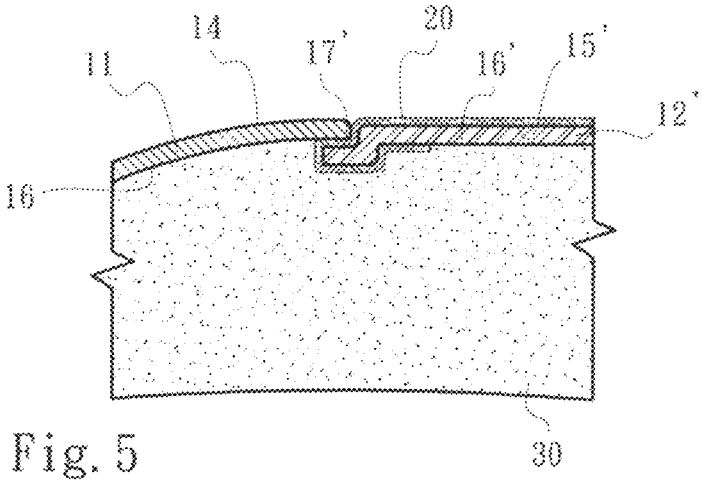
FIG. 5 is a sectional view of a part of the safety helmet of the present invention, showing that the decorative section or figure layer is folded back and adhered to the inner surface of the second section to wrap the edge thereof.

Referring to FIG. 3, the first and second sections 11, 12, 12' respectively have outer surfaces 14, 15, 15' (denoted in FIG. 5). In this embodiment, the outer surface 14 of the first section 11 is sprayed or painted. Decorative sections or figure layers 20 are adhered to the outer surfaces 15,15' of the second sections 12, 12'. The painting operation of the first section 11 and the figure layer adhesion operation of the second section 12' can be performed at the same time. In contrast, in the prior art, the figure layer adhesion operation can be locally performed only after the painted shell has dried. This leads to waste of time.

Figure 4:
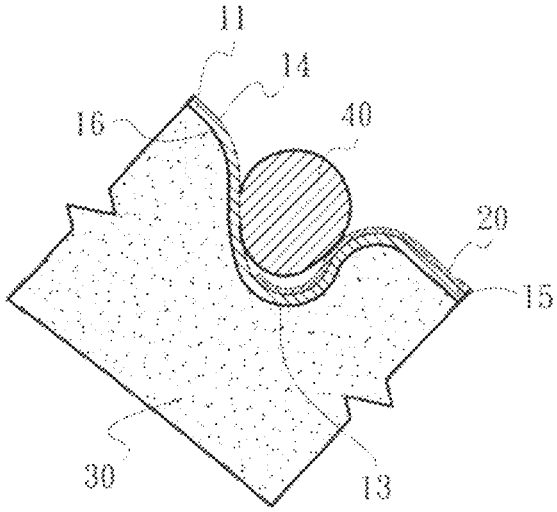
FIG. 4 is a sectional view of a part of the safety helmet of the present invention, showing the relationship between the extension section, the decorative section or figure layer, the decorative strip and the foam material filler of the present invention.

Referring to FIGS. 3 and 4, preferably, each the decorative section or figure layer 20 has a dimension or area equal to that of the second section 12, 12'. Alternatively, the decorative section or figure layer 20 has a dimension or area slightly larger than that of the second section 12, 12'. In this case, after the periphery of the decorative section or figure layer 20 totally or partially passes over an edge of the second section 12, the periphery of the decorative section or figure layer 20 enters the extension section 13 to cover the edge of the second section 12. Referring to FIG. 5, the figure layer adhesion operation of the second section 12' is slight different from that of the second section 12. After the periphery of the decorative section or figure layer 20 totally or partially passes over an edge of the second section 12' and an edge of the juncture section 17' thereof, the periphery of the decorative section or figure layer 20 is folded back and adhered to an inner surface 16' of the second section 12' to wrap the edge of the second section 12'. With respect to a worker not very skilled in adhesion process, the possibly crimped portion of the decorative section or figure layer 20 made of elastic material can be pushed into the extension section 13 or under the inner surface 16'. Accordingly, the decorative section or figure layer 20 can be smoothly attached to the surface of the safety helmet 10. Under such circumstance, it is unnecessary for the decorative section or figure layer 20 to have a dimension, which is strictly demanded to completely conform to the planned region of the safety helmet 10 as in the prior art.

Alternatively, with respect to the figure layer adhesion operation of the second section 12', a worker can first make the periphery of the decorative section or figure layer 20 totally or partially pass over the edge of the second section 12' and then fold the periphery of the decorative section or figure layer 20 back over the inner surface 16' of the second section 12'. Thereafter, the juncture section 17' of the second section 12' is connected with the first section 11 to fixedly clamp the periphery of the decorative section or figure layer 20 between the first section 11 and the edge of the second section 12', whereby the periphery of the decorative section or figure layer 20 can wrap the edge of the second section 12'. It should be noted that the first section 11 and the juncture section 17' of the second section 12' can be selectively connected in many manners. For example, in a preferred embodiment, the second section 12' is made of an elastic material, whereby the second section 12' can be chucked in the first section 11.

As aforesaid, the first and second sections 11, 12, 12' together form a subassembly of the safety helmet. FIGS. 4 and 5 show that a buffer material or a foam material filler 30 is filled between the first and second sections 11, 12, 12'. In this embodiment, the subassembly of the safety helmet is placed into a mold (such as a vacuum mold or an injection mold). The foam material filler 30 is heated, whereby the subassembly of the safety helmet encloses the foam material filler 30. Accordingly, the first and second sections 11, 12, 12' and the foam material filler 30 together form an integrated compact body as a safety helmet assembly.

Referring to FIG. 4, a decorative strip 40 is positioned on the extension section 13 between the first section 11 and the second section 12. The decorative strip 40 fills in the extension section 13 to enhance quality feeling of the safety helmet. Referring to FIG. 5, after the decorative section or figure layer 20 is overlaid on the second section 12' to wrap the edge thereof, the juncture section 17' is connected to the inner surface 16 of the first section 11 and bonded with the foam material filler 30.

Figure 8:
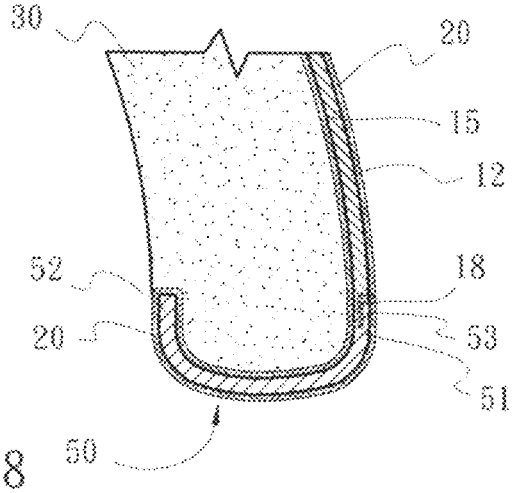
FIG. 8 is a sectional view of the safety helmet of the present invention, showing that the frame body is mounted under the bottom of the safety helmet.
Figure 7:
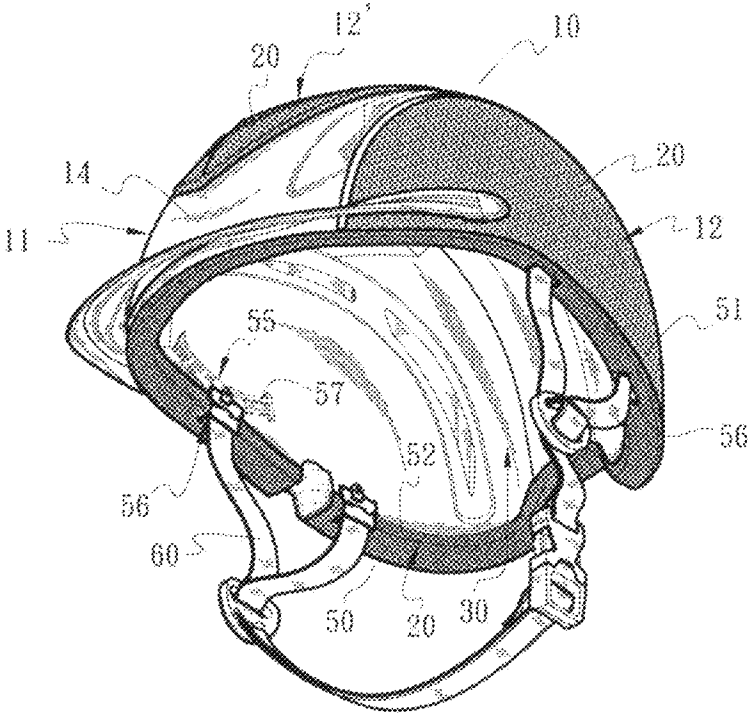
FIG. 7 is a perspective partially sectional view of the safety helmet of the present invention, showing that the frame body is mounted under the bottom of the safety helmet.
Figure 6:
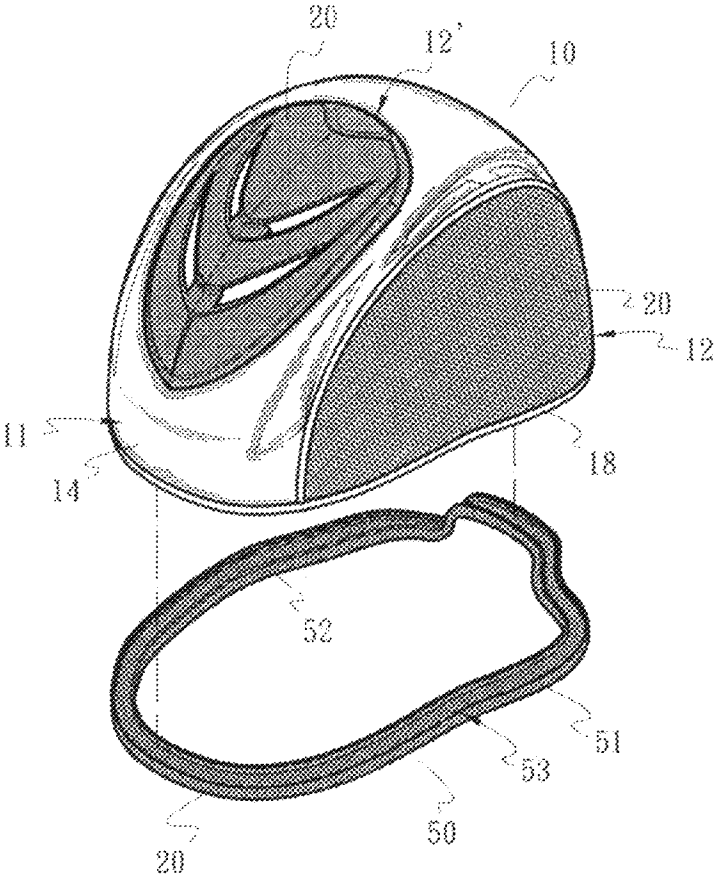
FIG. 6 is a perspective view of the safety helmet of the present invention, showing that the frame body is mounted under the bottom of the safety helmet.

Referring to FIGS. 6, 7 and 8, in a preferred embodiment, a frame body 50 is mounted under a bottom of the safety helmet assembly for protecting the bottom of the safety helmet assembly and enhancing quality feeling thereof. The frame body 50 has a substantially U-shaped cross-section with an outer wall 51 and an inner wall 52. The frame body 50 is wrapped with a decorative section or a figure layer 20.

Referring to FIG. 8, the outer wall 51 is formed with a juncture section 53 for connecting with a juncture section 18 of the bottom of the safety helmet 10. In this embodiment, the decorative section or the figure layer 20 is made of fabric material and encloses the frame body 50 along the U-shaped cross-section thereof.

FIG. 7 shows the assembly of the safety helmet 10, the frame body 50 and the fastening strap 60. Several fixing seats 55 are disposed on the frame body 50. The fastening strap 60 can be conducted through the frame body 50 or an opening 56 of lower side of the fixing seat 55 with a tail end section of the fastening strap 60 assembled with an insertion pin (not shown). The tail end section of the fastening strap 60 is held in the fixing seat 55 to assemble the fastening strap 60 with the safety helmet. As shown in FIG. 7, the fixing seat 55 has two arms 57 extending from two sides of the fixing seat 55 to help the fixing seat 55 in holding the foam material filler 30.

The processing method for the safety helmet structure of the present invention includes steps of:

(a) respectively forming the first and second sections 11, 12, 12' in accordance with the regions of or positions on the surface of the safety helmet 10 where the decorative sections or figure layers 20 are planned to be laid out, the first and second sections 11, 12, 12' having outer surfaces 14, 15, 15' respectively, an extension section 13 being defined between the first section 11 and the second section 12, an edge of the second section 12' being formed with a juncture section 17';

(b) attaching the decorative section or figure layer 20 to the outer surfaces 15, 15' of the second sections 12, 12', after the periphery of the decorative section or figure layer 20 totally or partially passes over an edge of the second section 12, the periphery of the decorative section or figure layer 20 entering the extension section 13 or being folded back and adhered to an inner surface 16' of the second section 12' to wrap the edge of the second section 12' as shown in FIGS. 4 and 5;

(c) connecting the juncture section 17' of the second section 12' with the first section 11, whereby the first section 11 and the second section 12' are connected to form a subassembly of the safety helmet; and (d) placing the subassembly of the safety helmet into a mold in which a buffer material or foam material filler is filled, whereby the subassembly of the safety helmet is integrally bonded with the foam material filler 30 to together form a safety helmet assembly.

In a preferred embodiment, the processing method of the present invention further includes a step of (e) mounting a frame body 50 under a bottom of the safety helmet assembly. The frame body 50 has a substantially U-shaped cross-section and is wrapped with a decorative section or a figure layer 20.

Alternatively, in step (b), after the decorative section or figure layer 20 is attached to the outer surface 15' of the second section 12', a worker can first make the periphery of the decorative section or figure layer 20 totally or partially pass over the edge of the second section 12' and then fold the periphery of the decorative section or figure layer 20 back over the inner surface 16' of the second section 12'. Then, in step (c), the juncture section 17' of the second section 12' is connected with the first section 11 to fixedly clamp the periphery of the decorative section or figure layer 20 between the first section 11 and the edge of the second section 12', whereby the periphery of the decorative section or figure layer 20 can wrap the edge of the second section 12'.

According to the above arrangement, the safety helmet structure and the processing method thereof of present invention have the following advantages over the prior art:

1. The safety helmet 10 includes the first and second sections 11, 12, 12', which are formed in accordance with the regions of or positions on the surface of the safety helmet 10 where the decorative sections or figure layers 20 are planned to be laid out. The decorative sections or figure layers 20 can be adhered to the outer surfaces 15, 15' of the second sections 12, 12' at the same time when the first section 11 is sprayed or painted. In contrast, in the prior art, the figure layer adhesion operation can be locally performed only after the entire painted shell has dried. This leads to waste of time. Moreover, in the prior art, in the figure layer adhesion operation, an unskilled worker often incautiously applies excessive adhesive to other regions of the helmet to contaminate the same. This is improved in the present invention.
2. In the prior art, only those skilled operators are relied on to perform the figure layer adhesion operation. In contrast, in the present invention, the periphery of the decorative section or figure layer 20 that exceeds the planned or set regions can be positioned in the extension section 13 or folded back and adhered to the inner surface 16' of the second section 12' to wrap the edge of the second section 12'. Accordingly, the decorative section or figure layer 20 can be smoothly attached to the surface of the helmet 10. Therefore, the problem existing in the prior art that the figure layers, (especially those made of elastic attachable papers or fabrics), are likely to be squeezed or crimped can be solved. Accordingly, it is no more necessary for a worker to further fix the decorative section or figure layer 20 so as not to ruin any other portion of the surface of the helmet, on which a figure is sprayed or a figure layer is adhered. Therefore, the manufacturing time is shortened in comparison with the prior art.

3. The decorative section or figure layer 20 is allowed to have a dimension or an area slightly larger than that of the second section 12, 12'. Under such circumstance, it is unnecessary for the decorative section or figure layer 20 to have a dimension, which is strictly demanded to completely conform to the planned region of the helmet as in the prior art. Therefore, the required precision of the elastic attachable fabric materials supplied by manufacturers can be reduced.

The above embodiments are only used to illustrate the present invention, not intended to limit the scope thereof. Many modifications of the above embodiments can be made without departing from the spirit of the present invention.

What is claimed is:

1. A safety helmet structure comprising:

a first section having an outer surface and an inner surface;

a second section having an outer surface and an inner surface;

an extension section defined between the first and second sections, said extension section extending into a recess formed on said helmet, said extension section being contiguous with said first and second sections; and a first decorative section or a figure layer adhered to and overlaid on the outer surface of the second section, a periphery of the first decorative section or figure layer at least partially passing over an edge of the second section, the periphery of the first decorative section or figure layer being positioned within the extension section whereby there is a smooth adherence of the first decorative section to a set region of the helmet;

wherein the periphery of a second decorative section or figure layer is partially folded back and adhered to an inner surface of a third section.

2. The safety helmet structure as claimed in claim 1, wherein the extension section is a groove having a geometrical configuration.

3. The safety helmet structure as claimed in claim 1, wherein the first and second sections together form a helmet subassembly of the safety helmet, the helmet subassembly being integrally bonded to a buffer material to form a helmet assembly.

4. The safety helmet structure as claimed in claim 3, wherein the buffer material is a foam material filler.

5. The safety helmet structure as claimed in claim 1, wherein a decorative strip is positioned on the extension section.

6. The safety helmet structure as claimed in claim 1, wherein the helmet has a bottom and a frame body is mounted under the bottom of the helmet.

7. The safety helmet structure as claimed in claim 6, wherein the frame body has a substantially U-shaped cross-section with an outer wall and an inner wall, the frame body being wrapped with a third decorative section or a figure layer.

8. The safety helmet structure as claimed in claim 7, wherein the outer wall of the frame body is formed with a juncture section for connecting with a juncture section of the bottom of the helmet.

9. The safety helmet structure as claimed in claim 1, wherein the first decorative section or figure layer has a dimension or an area slightly larger than that of the second section.

10. The safety helmet structure as claimed in claim 1, wherein an edge of a third section (12') is formed with a juncture section (17').

11. The safety helmet structure as claimed in claim 10, wherein the juncture section (17') is a stepped juncture section.

12. A safety helmet structure comprising:

a first section and a second section, each having an outer surface and an inner surface;

a third section (12') having an outer surface and an inner surface;

a juncture section disposed on an edge of the third section (12') for connecting the third section (12') with the first section, said juncture section extending under said first section; and a decorative section or a figure layer adhered to and overlaid on the outer surface of the third section (12'), a periphery of the decorative section or figure layer at least partially passing over the edge of the third section (12'), the periphery of the decorative section or figure layer is folded back over the inner surface of the third section (12') whereby there is a smooth adherence of the decorative section to a set region of the helmet;

wherein the helmet has a bottom and a frame body mounted under the bottom of the helmet.

13. The safety helmet structure as claimed in claim 12, wherein the decorative section or figure layer has a dimension or an area slightly larger than that of the third section, whereby the periphery of the decorative section or figure layer is partially folded back and adhered to the inner surface of the third section.

14. The safety helmet structure as claimed in claim 12, wherein the edge of the third section is formed with a juncture section.

15. The safety helmet structure as claimed in claim 12, wherein the juncture section is a stepped juncture section.

16. The safety helmet structure as claimed in claim 12, wherein the first and second sections together form a helmet subassembly, the helmet subassembly being integrally bonded with a buffer material to form a helmet assembly.

17. The safety helmet structure as claimed in claim 12, wherein the buffer material is a foam material filler.

18. The safety helmet structure as claimed in claim 12, wherein the frame body has a substantially U-shaped cross-section with an outer wall and an inner wall, the frame body being wrapped with a decorative section or a figure layer.

19. The safety helmet structure as claimed in claim 18, wherein the outer wall of the frame body is formed with a juncture section for connecting with a juncture section of the bottom of the helmet.

20. A processing method for a safety helmet structure, comprising steps of:

a. respectively forming at least one first section, at least one second section and a third section, the first section having an outer surface and an inner surface, the second section having an outer surface and an inner surface, the third section having an outer surface and an inner surface;

b. attaching a first decorative section or a figure layer to the outer surface of the second section, and attaching a second decorative section or a figure layer to the outer surface of the third section;

c. passing a periphery of the second decorative section or figure layer over an edge of the third section, the periphery of the second decorative section or figure layer wrapping around the edge of the third section;

d. connecting the third section with the first section to form a helmet subassembly;

e. integrally bonding the helmet subassembly with a buffer material to form a helmet assembly; and f. mounting a frame body under a bottom of the helmet assembly.

21. The processing method for the safety helmet structure as claimed in claim 20, wherein the first and second sections are defined in accordance with the regions of the surface of the helmet where the first and second decorative sections or figure layers are planned to be laid out.

22. The processing method for the safety helmet structure as claimed in claim 20, wherein an extension section is defined between the first section and the second section.

23. The processing method for the safety helmet structure as claimed in claim 22, wherein the extension section is a groove with a geometrical configuration.

24. The processing method for the safety helmet structure as claimed in claim 20, wherein an edge of the third section is formed with a juncture section.

25. The processing method for the safety helmet structure as claimed in claim 24, wherein, the juncture section is a stepped juncture section.

26. The processing method for the safety helmet structure as claimed in claim 20, wherein the buffer material is a foam material filler.

27. The processing method for the safety helmet structure as claimed in claim 20, wherein the first decorative section or figure layer has a dimension or an area slightly larger than that of the second section.

28. The processing method for the safety helmet structure as claimed in claim 20, wherein in step (c), after a periphery of the second decorative section or figure layer passes over the edge of the third section, the periphery of the second decorative section or figure layer is folded back over the inner surface of the third section.

29. The processing method for the safety helmet structure as claimed in claim 22, wherein in step (c), after a periphery of the first decorative section or figure layer passes over an edge of the second section, the periphery of the first decorative section or figure layer is adhered to the extension section.

30. The processing method for the safety helmet structure as claimed in claim 20, wherein the frame body has a substantially U-shaped cross-section with an outer wall and an inner wall, the frame body being wrapped with a third decorative section or figure layer.

31. The processing method for the safety helmet structure as claimed in claim 20, wherein the outer wall of the frame body is formed with a juncture section for connecting with a juncture section of the bottom of the helmet.

* * * * *